United States Patent [19]

Morita et al.

[11] Patent Number: 4,878,091

[45] Date of Patent: Oct. 31, 1989

[54] MULTICOLOR IMAGE FORMING APPARATUS

[75] Inventors: Shizuo Morita; Kazushi Hayakawa; Kunio Ito; Shunji Matsuo; Masakazu Fukuchi; Noboru Hatakeyama, all of Hachioji, Japan

[73] Assignee: Konica Corporation, Tokyo, Japan

[21] Appl. No.: 244,935

[22] Filed: Sep. 15, 1988

[30] Foreign Application Priority Data

Sep. 17, 1987 [JP] Japan ..... 62-234494
Oct. 26, 1987 [JP] Japan ..... 62-270553

[51] Int. Cl.[4] ..... G03G 15/08; G03G 15/01

[52] U.S. Cl. ..... 355/260; 355/245; 355/251; 355/326; 430/120; 118/645

[58] Field of Search ..... 355/245, 260, 326, 257; 430/120, 357; 118/645, 653

[56] References Cited

U.S. PATENT DOCUMENTS 4,601,259 7/1986 Yamashita ..... 118/658
4,710,016 12/1987 Watanabe ..... 355/326 X
4,746,954 5/1988 Matuura et al. ..... 355/326 X
4,754,301 6/1988 Kasamura et al. ..... 355/326 X

*Primary Examiner*—A. C. Prescott
*Attorney, Agent, or Firm*—Jordan B. Bierman

[57] ABSTRACT

A multicolor image forming apparatus wherein a plurality of developing devices for forming a multicolor image are integrally supported by a support member which can be inserted into and withdrawn from an apparatus body, and a plurality of resupply devices for replenishing toner particles are mounted on each of the developing devices. Each of the developing devices and each of the resupply devices corresponding to each of the developing devices are automatically connected to and disconnected from each other, when the support member is inserted into and withdrawn from the apparatus body. The support member further supports an image retainer and if necessary a cleaning member integrally.

13 Claims, 10 Drawing Sheets

MULTICOLOR IMAGE FORMING APPARATUS

BACKGROUND OF THE INVENTION

1. Field of the Invention

The present invention relates to a multicolor image forming apparatus in which a latent image formed on a photosensitive drum as an image retainer is developed by a plurality of developing means, each of which includes one of multicolor developers, to obtain a color copy using the electrophotographic technique.

2. Prior Art

There have been various methods and apparatus to provide a color image using the electrophotographic technique. According to one method as disclosed in Japanese Patent Laid-Open No. 61-100770, for example, latent images are formed and developed on a photosensitive drum dependent on the number of separated colors of a document image. Whenever each latent image is developed, it is transferred successively onto a transfer drum to form a multicolor image which is then transferred onto a sheet of recording paper to obtain a color copy. An apparatus practicing this method requires, along with the photosensitive drum, the transfer drum which has its circumferential surface enough in size to allow transfer of an image of one sheet onto it. Thus, the apparatus is necessarily increased in dimension and complicated in structure.

In another method as disclosed in Japanese Patent Laid-Open No. 61-149972, latent images are formed and developed on a photosensitive drum dependent on the number of separated colors of a document image. Whenever each latent images is developed, it is transferred successively onto a transfer member to directly obtain a multicolor copy. With this method, difficulty is encountered in superposing images of different colors with high accuracy and a color copy of good quality cannot be obtained.

There is also known a method in which latent images are formed and developed by color toner on a photosensitive drum dependent on the number of separated colors of a document image in a repeated manner, so that powder materials of different colors are superposed on the photosensitive drum and then transferred to obtain a color image.

The basic process of this type multicolor image formation is disclosed in Japanese Patent Laid-Open Nos. 60-75850, 60-76766, 60-95456, 60-95458, and 60-158475 all filed by the applicant.

In the multicolor image forming apparatus which provides a color image using such superposition process, a plurality of developing devices containing therein respective toner of different colors are disposed along the circumference of the photosensitive drum, and the photosensitive drum is usually rotated a plurality of times to successively develop latent images on the photosensitive drum for providing the color image.

The multicolor image forming apparatus having a photosensitive drum, on which images of different colors are superposed, cannot use conventional developing means that includes a magnetic brush brought into the image retainer for development. The applicant made it possible to practice a multicolor image forming apparatus in which toner images are superposed on the image retainer using a non-contact developing technique as disclosed in Japanese Patent Laid-Open No. 57-147652, etc.

For general reproducing machines, as disclosed in Japanese Patent Publication No. 58-54392, it has been proposed to integrally mount a photosensitive drum, a developing device and a cleaner together on a support member for facilitating replacement and repair of respective units. Also, Japanese Patent Laid-Open No. 57-154255 discloses to constitute those components for monocolor copying into an integral structure which is disposable for facilitation of replacement. However, any of those prior arts is not intended to improve quality characteristics of an image, maintainability and serviceability of multicolor image forming apparatus comprising a plurality of developing devices for multicolor or full-color copying.

Problem to be Solved by the Invention

When a plurality of developing devices are disposed along the circumference of a photosensitive drum, more toner particles are scattered in the apparatus as compared with usual reproducing machines, and hence maintenance operations such as service and maintenance must be carried out more frequently.

In the above-mentioned multicolor image forming apparatus in which toner images are superposed on the image retainer to obtain the color image, the apparatus is complicated and increased in size. Particularly, a plurality of developing devices are required to individually keep high-accurate gap size with respect to the surface of the photosensitive drum, and handling a plurality of developing devices is very troublesome. Thus, it could hardly be expected to facilitate service and maintenance operations.

In particular, the developing device using a two-component developer needs inevitable maintenance operations such as replacement of the developer and cleaning of scattered toner particles, unless it is disposable. Other various maintenance operations such as cleaning and replacement of a density detector, cleaning of bias contacts and contact reeds, etc. are also needed. Although handling a plurality of developing devices to form a color image makes such maintenance operations more complicated, there have not been proposed any effective solutions to achieve simplification thereof.

The problems to be solved are summarized as follows.

(1) In the foregoing multicolor image forming apparatus adapted to form a general color image or a superposed color image, since the respective developing devices are constituted differently in their arrangement and configuration due to structural limitation of the apparatus, there has been a problem that a photosensitive member may be damaged at the time of replacement of itself, or when any of the developing devices is withdrawn at the time of replacement of a developer. It is also necessary for each of the developing devices to have a mechanism to move it toward and away from the photosensitive member for overcoming the problem that a toner image developed by toner of some color on the photosensitive member may be scratched by the developing device containing toner of another color, and hence the toner image is disordered or mixed with another color. A further problem arises in mechanical arrangement and timing setting associated with bias switching or so. Along with the complicated structure, operability and maintainability become very troublesome because of need of handling a plurality of developing devices. The number of parts is large and reliability is relatively low.

(2) Meanwhile, there are known various types of so-called rotary developing devices in which respective developing devices arranged at predetermined locations on a rotatable body for each developing color are rotated through a certain degree successively to develop images of every colors in the same place, but this method has a difficulty in ensuring high positional accuracy while allowing rotational movement. Particularly, many problems arise in the field of non-contact development that a mechanism for setting a gap (Dsd) between an image retainer and a developer carrying member is complicated and hence can hardly assure the satisfactory accuracy, and that the time necessary for rotation of the developing devices makes it difficult to speed up the operation.

(3) Image quality may be deteriorated because of changes in developing characteristics due to fluctuations of Dsd caused by varying drum diameter attendant on temperature changes in both inner and outer sides of the apparatus, or fluctuations of Dsd caused by effects of inner vibration and outer vibration or impact attendant on operation of the mechanical rotary members or so, which depend on the diameter of the photosensitive drum. In practice, while the fluctuations of Dsd requires the accuracy on the order of $\pm 0.02 \sim 0.03$ mm, the rotational eccentricity of the drum axis is normally on the order of $\pm 0.005 \sim 0.01$ mm, and the gap between the drum surface and the developing device as incorporated in the apparatus body fluctuates on the order of $\pm 0.1 \sim 0.3$ mm. Because of fluctuations of temperature inside the apparatus at an ambient temperature ($5 \sim 35°$ C.) during operation, the aluminum-based drum currently used expands or contracts on the order of $\pm 0.01 \sim 0.02$ mm. This will adversely affect the image quality, e.g., color mixing and color balance, in combination with voltage fluctuations during development as described in the above (2).

(4) A principal problem to be solved by the present application is as follows: The developing devices contain respective developers of specific colors and perform their developing processes in synchronous relation with timing at which static latent images corresponding to specific colors are formed on the image retainer. Thus, if the developing devices are installed in incorrect load positions, a color image faithful to the document cannot be reproduced.

Furthermore, in connection with color converting function to develop an intentionally specified different color from that of the document, and digital image forming, there is needed a combination of image editing functions (such as enlargement, reduction, masking and trimming), which are especially widely employed at high rate of utilization, and a full-color or partial color converting function. In this context, installation of the developing devices for color copying in incorrect load positions gives rise to a serious problem. Generally, in color developing devices of the type that resupply hoppers are provided separately from the developing devices for resupply of toner to them, pipes or bellow pipes each housing therein a spiral spring are used to feed toner to the respective developing devices.

With this method, however, since the structure is complicated and a developer of good fluidity has to be employed, toner particles tend to scatter more easily and hence a higher degree of airtightness is required.

In case of integrally attaching the developing devices, together with the image retainer, on a support member which can be withdrawn from the apparatus body, an important problem is encountered in connecting the installed developing devices with the respective resupply hoppers directly mounted on the apparatus body.

Further, the developing devices contain respective developers of specific colors and perform their developing processes in synchronous relation with timing at which static latent images corresponding to specific colors are formed on the image retainer. Thus, if the developing devices are installed in incorrect load positions, a color image faithful to the document cannot be reproduced.

For the same reason, the resupply hoppers fixed to the apparatus body must be installed in respective proper load positions where they are surely joined to the corresponding developing devices of specific colors.

Although the resupply hoppers are removed from the apparatus body less frequently than the developing devices, installation thereof in incorrect load positions at the time of maintenance will cause mixing of toner particles of different colors and hence invite a serious trouble in the process of color image forming or maintenance for repairs. This will not only interrupt operation of the apparatus, but also require a lot of labor and time for the postprocessing.

SUMMARY OF THE INVENTION

It is an object of the present invention to overcome the problems as mentioned above, and to provide a multicolor image forming apparatus which can improve operability of assembly, adjustment, maintenance, and inspection, etc.

The foregoing object of the present invention is achieved by a multicolor image forming apparatus which has an apparatus body including an image retainer and process means such as a charging means for imparting electric charges to the image retainer, exposure means for performing image-exposing on the charged image retainer according to multicolor image informations, a plurality of developing means for developing respective static latent images formed on the image retainer by the exposure means, transfer means for transferring the developed image onto a recording medium, cleaning means for cleaning toner remaining on the image retainer after transfer, and a plurality of resupply means for replenishing toner to the plurality of developing means, wherein said plurality of developing means are integrally supported on a support member which can be inserted into and withdrawn from the apparatus body, and mutual developer resupply ports of the plurality of developing means and the plurality of resupply means provided in the apparatus body separately from the support member are automatically connected to and disconnected from each other, when the support member is inserted into and withdrawn from the apparatus body.

As an alternative, the image retainer and the plurality of developing devices may all be mounted on a support member which can be withdrawn from the apparatus body. Further, a plurality of developing devices and a plurality of resupply devices may be interconnected via a fool-proof mechanism such that only a pair of developing device and resupply device corresponding to a specific color can be joined to each other. Alternatively, it may be constructed such that the developing device corresponding to each specific color can be mounted only at a particular position of the support member. In addition, it may be possible that a plurality of developing devices are constituted by compact and thin developing devices, separately from the resupply means section, which can offer good image quality without affecting the image characteristics, and a principal part of a developing device housing is configured to be commonly used by at least two developing devices. More practically, the respective compact and thin developing devices are horizontally arranged with respect to the axis of the photosensitive drum in stacked fashion (in parallel to each other), and the total height of said plurality of stacked developing devices is preferably held within the outer diameter of the photosensitive drum (drum diameter).

Other objects and features of the present invention will be apparent in conjunction with the following description of the accompanying drawings.

PREFERRED EMBODIMENT

Figure 1:
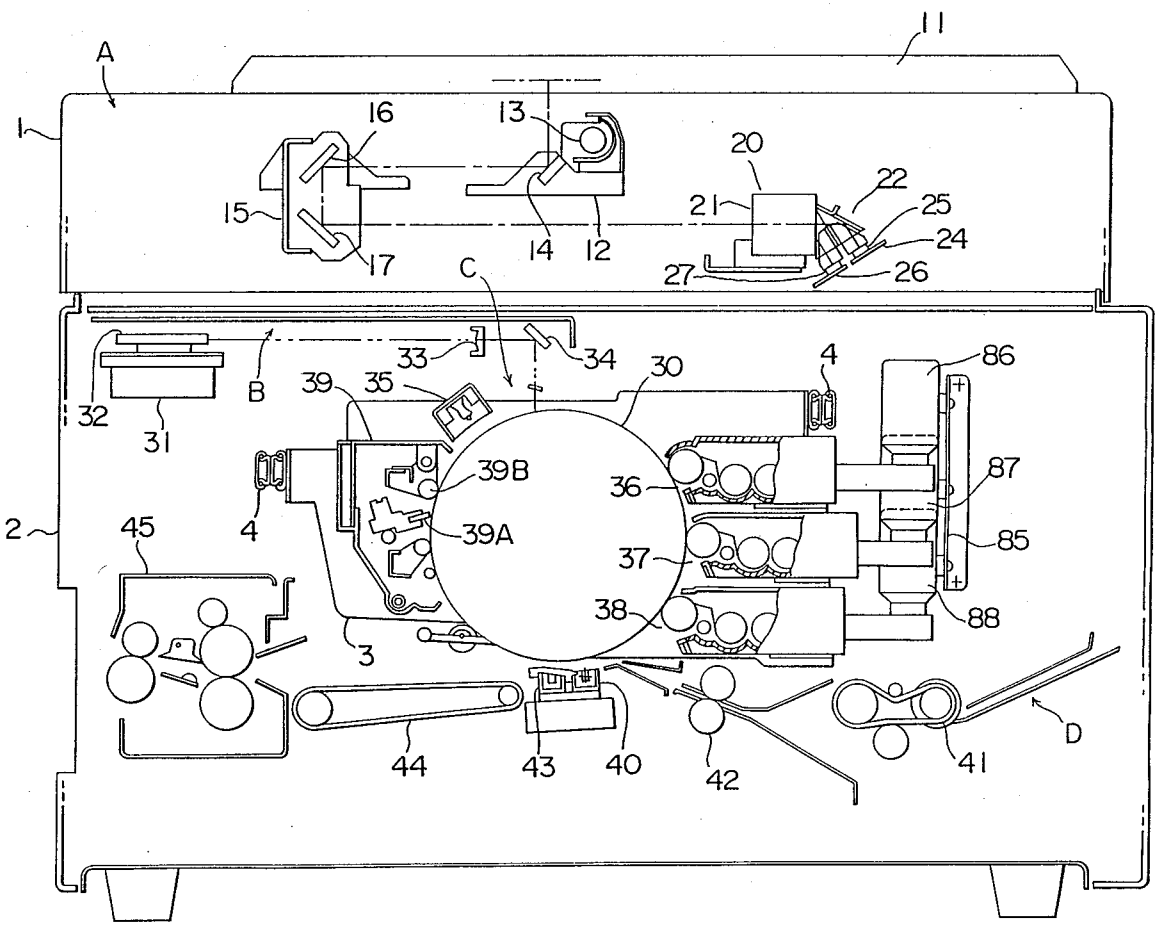
FIG. 1 is a sectional view of a multicolor image forming invention.

One embodiment of the present invention is shown in FIGS. 1 through 12. FIG. 1 illustrates the principal construction of a multicolor image forming apparatus in which designated at A is an image reading system, B a laser writing system, C an image forming station, and D a paper feeding station. A color image is formed through the following process.

In the image reading system A, designated at 11 is a document glass plate, and a document set on the document glass plate 11 is illuminated by a halogen lamp 13 attached to a carriage 12 which can slide horizontally. A movable mirror unit 15 includes mirrors 16, 17 mounted thereto, and also slides horizontally for leading a light image of the document to a lens reading station 20 in cooperation with a mirror 14 mounted on the carriage 12.

The carriage 12 and the movable mirror unit 15 are driven via wires (not shown) connected to a stepping motor (not shown) such that they slide at speeds V and (½)V in the same direction, respectively.

The lens reading station 20 comprises a lens 21, a prism 22, a first reading substrate 24, a red channel (hereinafter referred to as R-ch) CCD 25, a second reading substrate 26, and a cyan channel (hereinafter referred to as C-ch) CCD 27.

The optical image of the document transmitted through the mirrors 14, 16 and 17 is condensed by the lens 21, and separated by a dichroic mirror provided in the prism 22 into an R-ch image and a C-ch image which are then focused onto the light receiving surfaces of the R-ch CCD 25 mounted on the first reading substrate 24 and the C-ch CCD 27 mounted on the second reading substrate 26, respectively.

Image signals output from the R-ch CCD 25 and the C-ch CCD 27 are processed in a signal processing station. The signal processing station outputs color signals resulted from color separation of the image signals corresponding to toner colors, the color signals being applied to the laser writing system unit B as exposure means.

In the laser writing system unit B, a laser beam generated from a semiconductor laser (not shown) is rotation scanned by a polygon mirror 32 rotated by a driver motor 31, and has its optical path bent by a mirror 34 after having passed through an Fθ lens 33. Thereafter, the laser beam is projected onto the circumferential surface of an image retainer 30, to which electric charges have previously been applied by a charger 35 as charging means, for forming bright lines thereon.

At the beginning of scan, the laser beam is sensed by an index sensor and then modulated with a first color signal. The modulated beam scans the circumferential surface of the image retainer 30. Accordingly, in combination of main scan of the laser beam and subscan effected by rotation of the image retainer 30, a latent image corresponding to the first color is formed on the circumferential surface of the image retainer 30. This latent image is developed by a developing device 36 loaded with red toner (image developing medium), for example, among a plurality of developing means, so that a red toner color is formed on the drum surface. The resulting toner image passes a cleaning device 39 as cleaning means spaced from the circumferential surface of the image retainer 30, while it remains held on the drum surface, and then enters a next copying cycle.

More specifically, the image retainer 30 is charged again by the charger 35, whereas a second color signal output from the signal processing station is applied to the laser writing system unit B, so that the second color signal is written onto the drum surface to form another latent image in the same manner as the case of the first color signal. This latent image is developed by a developing device 37 loaded with blue toner as a second color, for example.

The blue toner image is formed in superposing relation to the above red toner image which has been already formed there.

Designated at 38 is a developing device containing black toner, which serves to form a black toner image on the drum surface in response to a control signal generated from the signal processing station. AC and DC biases are applied to respective sleeves of the developing devices 36, 37, 38 for jumping development by two-component developers, so that development is made on the grounded image retainer 30 in non-contact manner.

The color image thus formed on the circumferential surface of the image retainer 30 is transferred at a transfer electrode 40, provided as transfer means, onto a sheet of recording paper as a recording medium fed from the paper feeding station D through a paper feeding belt 41 and feed rollers 42. The sheet of recording paper having the toner image transferred thereon is separated from the drum surface by a separation electrode 43, and then transferred through a transfer belt 44 to a fixing device 45 where the image is fixed permanently.

On the other hand, after the sheet of recording paper has been separated from the drum surface, the image retainer 30 is brought into contact with a blade 39A of the cleaning device 39 to remove any remaining toner. Following complete removal of the remaining toner, the blade 39A is drawn away from the drum surface, and the image retainer 30 then proceeds to the next process of color image forming.

Layout of the principal components will be described below. As illustrated in FIG. 1, the image reading system A is accommodated in a separate dedicated housing 1 and mounted on the top of an apparatus body 2 later described.

An image recording system comprising the laser writing system B, the image forming station C, the paper feeding station D, etc. is incorporated in the apparatus body 2 which receives color signals from the image reading system A via a group of flexible cables connected to the housing 1.

In the apparatus body 2, there is substantially centrally positioned the image retainer 30. The developing devices 36, 37, 38 are horizontally disposed along the righthand circumferential surface of the image retainer 30, while the charger 35 and the cleaning device 39 are disposed along the lefthand circumferential surface thereof.

Any of the image retainer 30, the developing devices 36, 37, 38 and the cleaning device 39 is not directly attached to a pair of front and rear base plates fixed to the apparatus body 2, but attached to a support member 3 by means of bearings or in a detachable manner, the support member 3 being removably assembled into the apparatus body 2.

Figure 3:
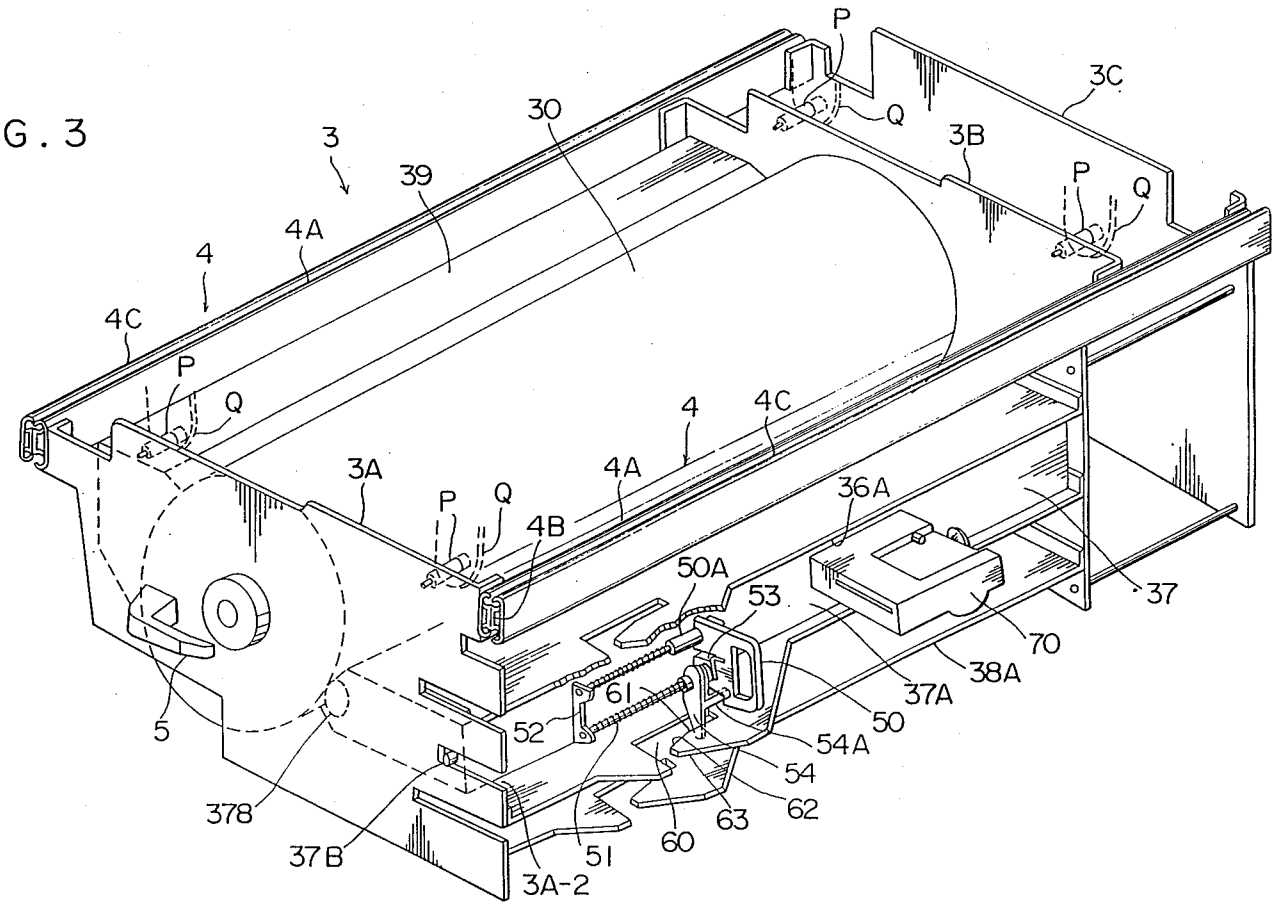

As shown in FIG. 3, the support member 3 is composed of three similar panels 3A, 3B, 3C which are fixedly interconnected by stays or the like into an integral structure, and can easily be removed from and mounted to the apparatus body 2 through a pair of laterally spaced guide members 4 each comprising a plurality of balls and rails.

More specifically, the support member 3 has a pair of rails 4A fixed to its left and right side edges, while the apparatus body 2 includes a pair of rails 4C fixed to positions corresponding to the rails 4A, these rails 4A and 4C being engaged with intermediate rails 4B through a plurality of balls, respectively, thereby forming a slidable pair.

A pair of laterally spaced reference pins P is attached to each of the back surface of panels 3A and 3B near the upper edges. The support member 3 is suspended when the reference pins P are engaged in holes bored in suspending members Q from the front and rear base plates fixed to the apparatus body 2, respectively. In this suspended state, the image retainer 30, the developing devices 36, 37, 38 and the cleaning device 39 all attached to the support member 3 are set in appropriate positional relationship with respect to the apparatus body 2.

Therefore, by pulling a grip 5 on the front face of the panel 3A, the support member 3 is withdrawn forwardly out of the apparatus body 2 to a large extent through the rails 4B as mediator members and a plurality of balls rolling between the rails. On the contrary, by pushing the grip 5, the reference pins P are engaged in the holes of the suspending members Q, respectively, so that the support member 3 is loaded into the apparatus body 2 again in a suspended state.

With such structure that the support member 3 is held in place with respect to the base plates of the apparatus body 2 in a suspended state, vibration and shock transmitted from motors and so on attached in the apparatus body 2 to the image retainer 30, the developing devices or the cleaning device are alleviated and absorbed significantly. Even if transmitted to some extent, the respective components are subjected to uniform vibration and shock. Thus, for example, a plurality of developing devices and the photosensitive drum remain kept in a relatively uniform condition, so there will occur no substantial trouble in the process of image forming.

Particularly, the above structure of supporting the image retainer 30 and the cleaning device 39 together on the support member 3 makes it possible to significantly alleviate and absorb detrimental influences of vibration and shock upon the delicate pressing fashion, the pressure contact state, the loading conditions, etc. at the time when the blade 39A and a second cleaning roller 39B used for removing the residual toner after release of the cleaning blade are brought into and away from contact or held in pressure contact with the image retainer 30 as an essential step in the cleaning device for image forming due to superposition development. These advantageous effects are similarly applied to the modified arrangement where the reference pins P on the panels 3A, 3B and the holes of the suspending members Q fixed to the apparatus body are interchanged to be provided on and in the opposite components. The support member 3 may be composed of two front and rear panel plates, and the three-panel structure as illustrated in the above embodiment of the present invention is not always needed.

In case of the foregoing image forming process of superposition type, the image retainer 30 requires its circumferential length equal to the length of one sheet of B4 or A3 size as a maximum recording medium plus a slight allowance, and hence requires its outer diameter on the order of 130 mm to 150 mm at minimum. This embodiment of the present invention employs a photosensitive drum with the outer diameter of 150 mm.

As to the developing devices 36, 37, 38 described later in detail, the outer diameter of a developing sleeve can be made as small as 20 mm without lowering the image forming capability, so that each developing device may have its thickness (height) of about 40 mm or less. As a result, it becomes possible to horizontally arrange, in a closely stacked assembly, three or four developing devices necessary for color copying, i.e., the developing devices 36, 37, 38 in this embodiment of the present invention, within a space corresponding to the outer diameter of the image retainer 30.

Therefore, even if the vertical height of the support member 3 is selected to a minimum limit size just enough to cover the image retainer 30 with a view of not affecting layout of the components directly fixed to the apparatus body 2 such as respective parts of the transfer system, the upper laser writing system unit B, the lower transfer electrode 40, and separation electrode 43, the support member 3 can carry and accommodate sufficiently all of a plurality of developing devices 36, 37, 38, along with the cleaning device 39. Thus, a transfer path of recording paper can be arranged in a substantially linear configuration, which is also effective in preventing jam of the recording paper. In the event of jamming, it can easily be handled.

The developing devices 36, 37, 38 are constructed as follows.

Figure 2:
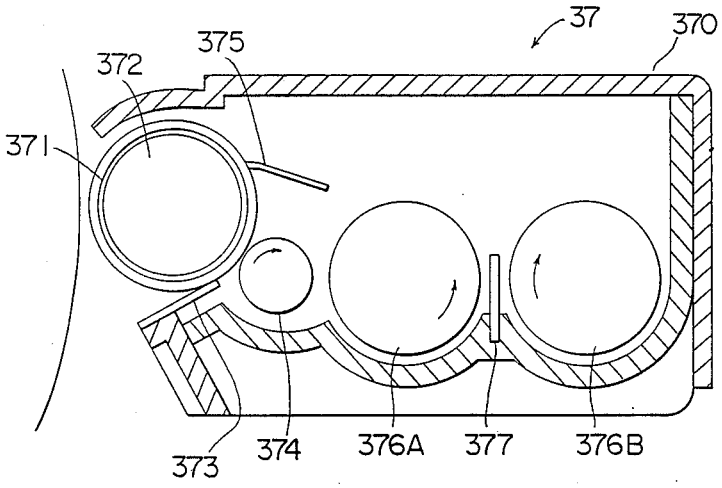
FIG. 2 is a sectional view of a developing device used in the apparatus.

In this embodiment, the developing devices 36, 37, 38 have all the same structure. Hence, the developing devices used in the present invention will be described below with reference to a sectional view of the developing device 37 as shown in FIG. 2.

Designated at 370 is a housing, 371 a developing sleeve, 372 a magnetic roll, 373 a developer layer forming plate, 374 a supply roller, 375 a developer layer scraping plate, 376A, 376B a pair of stirring screws, and 377 a stirring partition plate disposed between the stirring screws 376A and 376B.

The developing sleeve 371 disposed in the housing 370 with thickness of about 40 mm is a cylinder of stainless steel with outer diameter of 20 mm , and has a circumferential surface subjected to the sand blasting process of 3 μm. The developing sleeve 371 is rotated clockwise at a speed of 200 ~300 rpm to transfer a developer in the direction of arrow for feeding it to a developing area.

The magnetic roll 372 is formed of a magnet having twelve S and N poles alternately arranged along its circumferential surface, but with one of those magnetic poles omitted, and fixed inside the developing sleeve 371 to effect development. Note that while the magnetic roll 372 is fixed in this embodiment, it may be of a rotatable type. A portion of the fixed magnetic roll 372 corresponding to one magnetic pole omitted produces a repelling magnetic field, in which the developer layer scraping plate 375 is positioned around the developing sleeve 371 to scrape off the developer having passed the developing area to carry out development.

The supply roller 374 is of a sponge roller rotating clockwise in non-contact with the developing sleeve 371. Fresh toner is stirred and supplied upon rotation of the stirring screws 376A, 376B, and the supply roller 374 serves to quickly and uniformly feed the developer thus stirred to the developing sleeve 371.

Fresh developer is adhered to and transferred by the developing sleeve 371, and the developer layer adhered and transferred is restricted in its thickness by the developer layer forming plate 373 positioned in a downstream position.

The developer layer forming plate 373 is of an elastic thin plate having its base end fixed in place, and comprises a plate of phosphor bronze with thickness of 0.1 mm and a sheet of urethane rubber with thickness of 0.5 mm which are bonded to each other. The plate 373 is in slide contact against the circumferential surface of the developing sleeve 371 with a slight pressing force, and the developer restricted by the plate 373 to a thin layer is transferred by the developing sleeve 371 to the developing area. An amount of the developer on the developing sleeve 371 is restricted to 6 ~8 mg/cm$^2$.

A developing gap in the developing area is kept at 0.5 mm to carry out non-contact development.

The developing bias applied to the developing sleeve 371 consists of AC bias of 700 rmsV, 4 KHz and of DC bias of −500 V.

In the developing area that meets the foregoing conditions, toner is effectively supplied from the thin developer layer on the developing sleeve 371 toward the latent image surface on the image retainer. Since the developer layer is made very thin (10 μm ~450 μm) as mentioned above, non-contact development can satisfactorily be performed by narrowing the gap between the image retainer and the developing sleeve 371, i.e., the developing gap, down to 500 μm, for example. As the developing gap is narrowed, the electric field in the developing area is increased. This leads to an advantage that satisfactory development can be achieved even with the smaller developing bias voltage to be applied to the developing sleeve 371, and the possibility of leak discharge of the developing bias or the like is lessened correspondingly. Furthermore, resolution and other properties of the image are improved on the whole. An allowable range of the developing gap in this developing system is 500±300 μm, preferably 500±150 μm. In practice, a still smaller variation is desired because of various limitation factors. In the color reproducing machine of this embodiment, for example, 500 ±50 μm is earnestly preferable and must be maintained. The integrated structure of the present invention is advantageous in this respect.

The developing method using the very thin developer layer as mentioned above gives a remarkable effect on the developing device using a small-diameter sleeve, for example. More specifically, when non-contact development was carried out in the past using a small-diameter sleeve of less than 30 mm, for example, the developing gap of about 1 mm was needed because of difficulty in restricting a thickness of the developer layer. This resulted in several drawbacks that the higher voltage AC bias was necessary, that resolution, tone reproducibility, and entire quality of the image obtained through development were lowered, particularly, details of characters or so could not satisfactorily be reproduced, and that electrical insulation of the developing device required special cares in selecting materials and dimensions.

In contrast, according to the developing method by the use of the above-mentioned developing devices, since a very thin developer layer is formed to carry out development, the developing gap can be set smaller, and resolution, tone reproducibility, and other quality of the developed image are significantly improved because of the sufficiently increased electric field. A reduction in sleeve diameter leads to further advantages that the expensive developing device can be reduced in size and cost, that components necessary for image forming are easily arranged in a color electrophotographic apparatus using a plurality of developing devices, and hence that the apparatus becomes compact as a whole.

The developing method as mentioned above is also effective in allowing carrier and toner particles to be less scattered even in the case of using particles of smaller grain size (5 μm ~100 μm). More specifically, when development was carried out in the past using a developer consisted of carrier and toner of small grain size, there accompanied the problems that the carrier and/or toner particles were scattered and contaminated the interior of the apparatus, that toner particles of different color were mixed into the developing device containing toner of one color and hence color balance of the image was disordered, and that there occurred fog. However, the present developing method mentioned above can alleviate such problems to a large extent.

Another advantageous effect is in that since the developing method is implemented in a non-contact manner and only toner is selectively caused to fly toward the latent image surface for development, it becomes possible to prevent fog of toner and adhesion of carrier onto the latent image surface which phenomena are tend to occur particularly in case of using an image forming member having an organic photosensitive layer to carry out inverted development. Further, there is no possibility of damaging the surface of the image forming member and leaving any sweeping tracks thereon because the latent image surface is free of slide contact. It is also possible to keep good resolution and tone reproducibility, and to adhere a sufficient amount of toner onto the latent image surface. In addition, the non-contact development can perform another toner image on the image forming member in superposing relation to the toner image previously formed thereon, and hence it is suitable for multicolor development used in the multicolor image forming apparatus of the present invention.

The developing devices 36, 37, 38 can simply be assembled into the support member 3 in a detachable manner using the following installation mechanism.

There will be described below the case of the developing device 37 with reference to FIG. 3. On the back surface of the developing device 37, a pair of vertically spaced guide pins 51 each having a compressed spring fitted therearound is mounted between a pair of laterally spaced holders 52, so that a grip 50 slidably fitted over the guide pins 51 is urged rightward.

The grip 50 is fitted over and supported by the guide pins 51 through a pair of upper and lower bosses 50A. A pressing lever 54 urged counterclockwise by means of a torsion spring 53 is fixedly fitted over the lower boss 50A.

On the other hand, the support member 3 includes a guide plate 37A fixed thereto on which the developing device 37 is to be mounted, and the guide plate 37A has a key-like cutout 60 on its side edge at a position corresponding to the pressing lever 54.

In the state where the developing device 37 is installed in the support member 3, the pressing lever 54 is held in abutment against a linear portion 61 of the cutout 60 and hence slightly pushed clockwise. The resulting reaction force causes the developing device 37 to be pressed toward the image retainer 30 to keep the gap (Dsd) between the image retaining surface and the developing sleeve to a prescribed value (for example, the gap is ensured by such a structure that a roller 378 provided concentrically on the developing sleeve is abutted against the photosensitive drum).

When removing the developing device 37 from the support member 3, the grip 50 is slid leftward against the resilient action of the compressed springs, so that the pressing lever 54 now contacts a tapered portion 62 and starts to return back counterclockwise. During this return stroke, a projection 54A strikes against the grip 50, whereupon the pressing lever 54 is stopped.

Therefore, by pulling the grip 50 at a position where the boss 50A is striking against the holder 52, the pressing lever 54 comes off from an opening of the cutout 60, thereby allowing the developing device 37 to be removed and separated from the support member 3.

On the contrary, when installing the developing device 37 into the support member 3, the front end portion of the developing device 37 is placed on the guide plate 37A, and a pin 37B attached to the side of the developing device 37 is pushed to be engaged in a groove 3A-2 defined in the panel 3A, whereupon the pressing lever 54 on the grip 50 positioned at the right ends of the guide pins 51 under the action of the compressed springs now abuts against a tapered portion 63. Then, the pressing lever 54 is slid leftward together with the grip 50 on the guide pins 51 following an inclination angle of the tapered portion 63.

When the developing device 37 is further pushed at a position where the pressing lever 54 is facing the opening of the cutout 60, the grip 50 now slides rightward under the action of the compressed springs, and the pressing lever 54 comes into slide contact with the tapered portion 62. Then, the pressing lever 54 enters a range of the linear portion 61 while being rotated slightly clockwise, so that the developing device 37 is brought into the urged state as mentioned above. Note that the developing devices 36, 38 can also be loaded into the support member 3 in a detachable manner using a similar installation mechanism.

Further, each of the developing devices 36, 37, 38 is installed into the support member 3 through a foolproof mechanism in the form of a fitting mechanism which is made up by selection of various dimensions such as length, depth, width and relative positional relationships, as well as single or multiple combinations of the mechanical elements comprising parts of recesses such as grooves, holes, cutouts, etc. and projections such as dowels, rails, etc.

More specifically, the pins 37B are provided in vertically different positions on the front faces of the respective developing devices. When installing the development device 37 into the support member 3, the development device 37 is inserted with its bottom surface held in slide contact with the guide plate 37A. During this insertion stroke, the pin 37B enters the groove 3A-2 defined in the panel 3A at a corresponding level, thereby allowing the developing device 37 to be inserted and loaded into a predetermined grounded position.

Therefore, even if the developing device 37 is forced to be inserted while in slidably contact with the guide plate 36A or 38A, the pin 37B will strike against the side edge of the panel 3A and hence cannot be installed into the support member 3. In a like manner, it is not possible to insert and load the developing device 36 or 38 along the guide plate 37A. Consequently, there is realized such a structure that allows only a developing device for a specific color to be installed at a particular position associated with that specific color with respect to the image retainer 30.

Meanwhile, resupply hoppers 86, 87, 88 as resupply means prepared for replenishing toner to the developing devices 36, 37, 38, respectively, are directly attached to and supported by a hopper mount plate 85 fixed to the apparatus body separately from the support member 3. Attendant on the operation to install or remove the support member 3 with respect to the apparatus body, resupply ports of the resupply hoppers 86, 87, 88 can automatically be connected to or disconnected from those of the developing devices 36, 37, 38, respectively.

Figure 4:
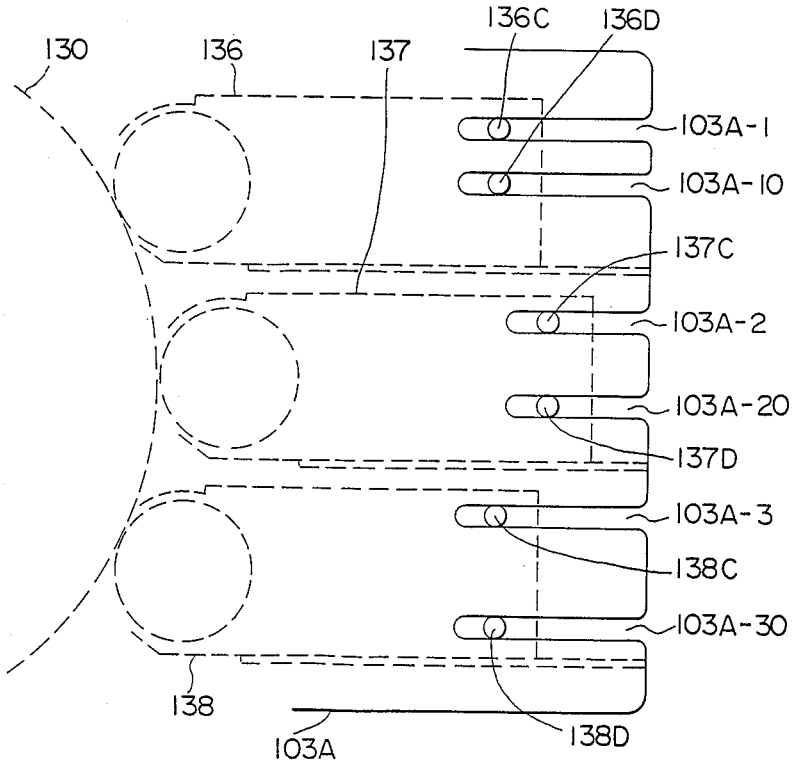
FIGS. 3, 4, and 5 are a perspective view, a front view and a side view of an essential part of the apparatus, respectively.

FIG. 4 shows an example in which respective load positions of the developing devices are restricted by pairs of pins provided at vertically different spacings. Developing devices 136, 137, 138 have pins 136C, 137C, 138C located at the same height with respect to the corresponding developing devices, and pins 136D, 137D, 138D located at different heights from each other. In the state where the developing devices are loaded in the respective proper positions, the pins 136C, 137C, 138C are engaged in grooves 103A-1, 103A-2, 103A-3 defined in the panel 3A at the same heights, respectively, while the pins 136D, 137D, 138D are engaged in grooves 103A-10, 103A-20, 103A-30 defined in the panel 3A at different heights from each other, respectively.

In other words, for example, the developing device 137 has the pair of pins 137C, 137D spaced by a particular distance, and cannot be installed at a load position where other developing device 136 or 138 is to be loaded. Likewise, the developing device 136 or 138 cannot be installed at a load position where the developing device 137 is to be loaded. Therefore, it becomes possible to surely prevent the erroneous operation, simplify the loading and unloading operation, and improve the color image processing function adaptable to color conversion or so with certainty.

Generally, the housing of each developing device is formed by molding of a plastic material in many cases. In this case, when fool-proof mechanisms are used to restrict types of the developing devices to be installed as with the present invention, the housings of the developing devices can be employed commonly, attachment holes for the respective pin groups can be formed at the same time, and hence the cost can be reduced due to mass production.

Moreover, the function of the fool-proof mechanism intended by the present application is further improved by adding proper recognition indications corresponding to respective specific colors, such as matching color marks, numbers, patterns or characters, on a plurality of developing devices and at the corresponding predetermined positions on the support member, and by providing similar matching marks on the support member in combination with the whole or a part of the housings or side plates of the developing devices colored with different colors.

Meanwhile, resupply hoppers 86, 87, 88 as resupply means prepared for replenishing toner to the developing devices 36, 37, 38, respectively, are directly attached to and supported by a hopper mount plate 85 fixed to the apparatus body separately from the support member 3. Attendant on the operation to install or remove the support member 3 with respect to the apparatus body, resupply ports of the resupply hoppers 86, 87, 88 can automatically be connected to or disconnected from those of the developing devices 36, 37, 38, respectively.

Figure 5:
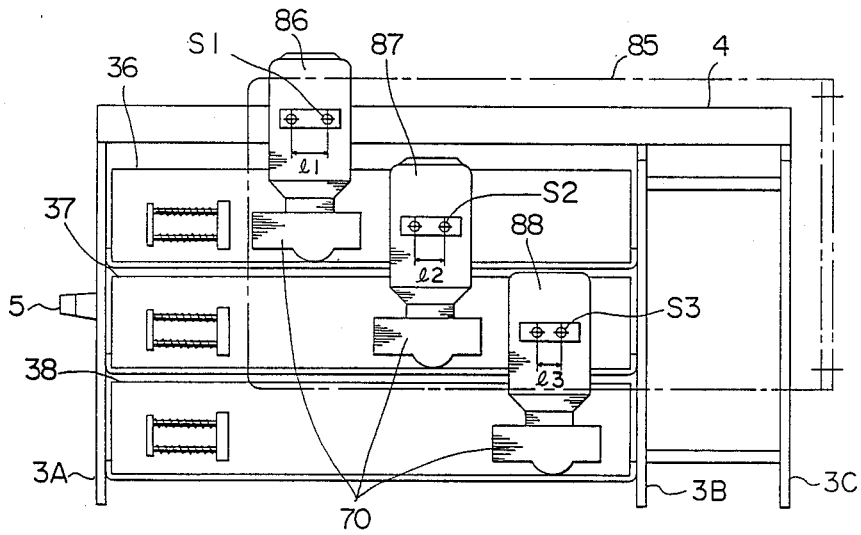

FIG. 5 shows a side view of FIG. 1. The resupply hoppers 86, 87, 88 contain toner of red, blue and black colors, respectively, and are fixed to the hopper mount plate 85 by means of every pairs of set screws which are attached thereto with different spacings, such that the resupply hoppers locate in respective particular positions shifted from each other in the depthwise direction of the apparatus body and at vertically different levels from above. In the state where the support member 3 is completely accommodated into the apparatus body, toner resupply sections 90 at the lower ends of the resupply hoppers 86, 87, 88 are respectively connected to toner resupply sections 70 of the developing devices 36, 37, 38 projecting from their back surfaces, as shown in FIG. 3, so that the mutual resupply ports are interconnected properly.

More specifically, the resupply hoppers 86, 87, 88 have respective pairs of threaded holes S1, S2, S3 bored in their mount surfaces held in contact with the hopper mount plate 85 and having different spacings l1, l2, l3 from each other. The resupply hoppers 86, 87, 88 are fixed by set screws at positions of pairs of through holes bored in the hopper mount plate 85 corresponding to the threaded holes S1, S2, S3, respectively.

As a result, any of the resupply hoppers 86, 87, 88 can be attached at the respective particular positions on the hopper mount plate 85 and then connected to the corresponding developing devices, as shown, without possibility of erroneous attachment.

Means for specifying mount positions of a plurality of resupply hoppers is not limited to the above-mentioned threaded holes with different spacings from each other for attaching the resupply hoppers. For example, reference pins for attachment may be provided such that they are engaged with guide members or the like for specifying respective attachment positions.

Figure 6:
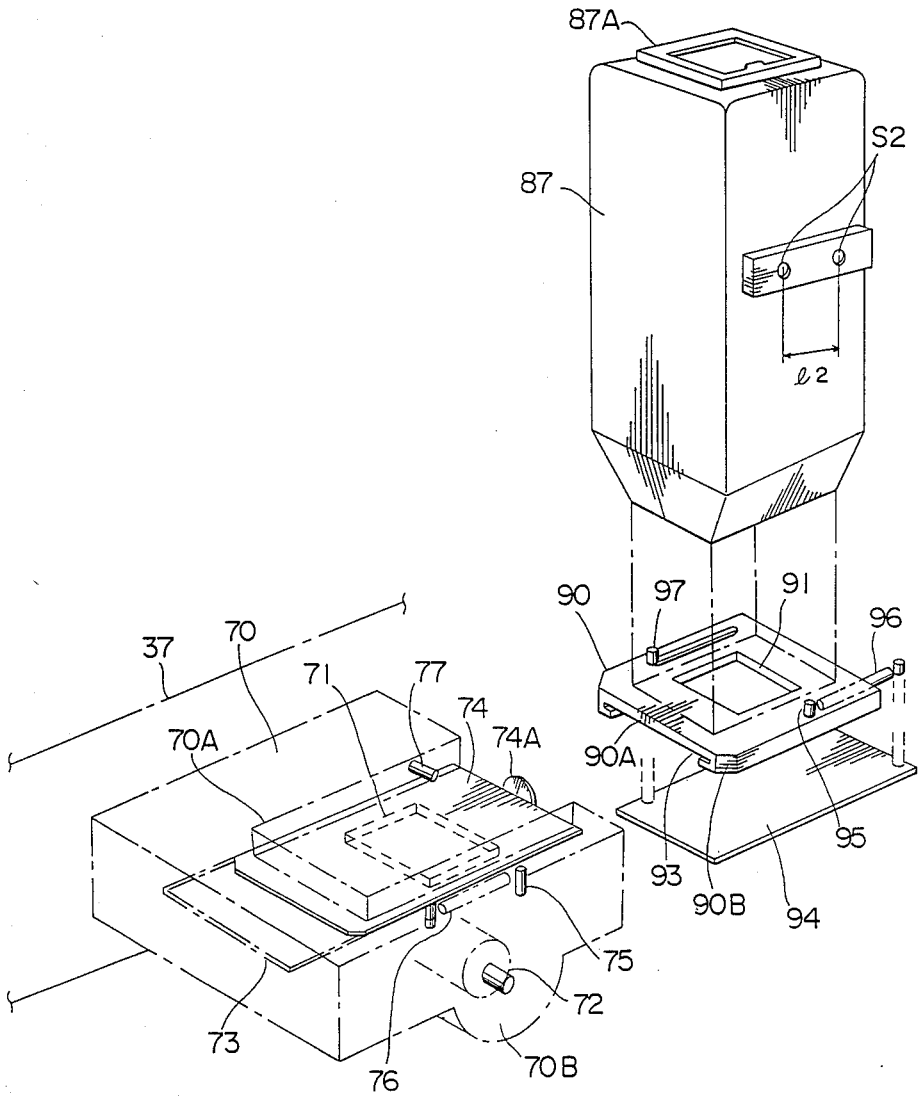
FIG. 6 is a developed perspective view of respective toner resupply sections of the developing device and a correspondingly resupply hopper.

FIG. 6 shows a toner resupply section 70 of each developing device and the toner resupply section 90 of each resupply hopper in the developed form.

The toner resupply section 70 comprises a hollow container which has formed in its top surface a rectangular spot-facing portion 70A in which a resupply port 71 is opened, and in its bottom surface a semicylindrical space 70B in which a toner feeding screw 72 is accommodated. With the function of the toner resupply section 70, toner replenished through the resupply port 71 is transferred to the developing device 37 upon rotation of the toner feeding screw 72.

A slit 73 is defined to extend from both sides of the spot-facing portion 70A to one outer side face of the toner resupply section 70, and a shutter plate 74 in the form of a thin plate is slidably fitted in the slit 73.

The shutter plate 74 is normally urged rightward under the action of a tension spring 76 stretched between the shutter plate 74 and a pin 75 fixed to the toner resupply section 70. In the illustrated position where the shutter plate 74 is shielding the resupply port 71, the shutter plate 74 is stopped while being abutted against a stopper (not shown).

On the other hand, the toner resupply section 90 is a frame-like member which has its width to be fitted in the spot-facing portion 70 of the toner resupply section 70 and also has a resupply port 91 open substantially at the center thereof. The toner resupply section 90 is integrally fixed to the lower end of the resupply hopper 87.

A slit 93 is defined in the bottom surface of the toner resupply section 90, and a shutter plate 94 in the form of a thin plate is slidably fitted in the slit 93.

The shutter plate 94 is normally urged leftward under the action of a tension spring 96 stretched between the shutter plate 94 and a pin 95 fixed to the toner resupply section 90. In the illustrated position where the shutter plate 94 is shielding the resupply port 91, the shutter plate 94 is stopped while being abutted against a stopper (not shown).

Accordingly, in the state where the support member 3 is withdrawn from the apparatus body, the resupply ports 71 and 991 of both the toner resupply sections are shielded by the respective shutter plates to completely prevent leakage of toner and intrusion of dust.

When the support member 3 is inserted in the depthwise direction for installation into the apparatus body, while being guided by the guide members 4, the spot-facing portion 70A of the toner resupply section 70 abuts against and fits with a pair of positioning tapered portions 90B of the toner resupply section 90, the tapered portions 90B being formed taking into account allowance which will be encountered in engaging a plurality of developing devices with the corresponding toner resupply sections, respectively. At the same time, a pawl 74A of the shutter plate 74 abuts against a front edge 90A of the toner resupply section 90.

Therefore, upon further insertion of the support member 3, the shutter plate 74 is slid leftward against the action of the tension spring 76 to open the resupply port 71. With a slight time lag, a pin 77 projecting from one side wall of the spot-facing portion 70A strikes against a pin 97 erected from the shutter plate 94 and penetrating through the toner resupply section 90, so that the shutter plate 94 is slid rightward against the action of the tension spring 96 to start opening of the resupply port 91.

The resupply ports 71 and 91 are opened gradually in step with the inserted operation of the support member 3, and when the support member 3 is completely installed at a predetermined position in the apparatus body, the resupply port 71 entirely matches the resupply port 91, thereby allowing toner in the resupply hopper 87 to be dropped and passed into the toner resupply section 70.

Although the resupply ports 71 and 91 are opened gradually in step with the inserted operation of the support member 3 as mentioned above, the resupply port 71 is selected to be somewhat larger than the resupply port 91, and also as stated above, the resupply port 91 starts to be opened with a slight time lag with respect to the resupply port 71. This can surely prevent leakage of toner particles which is liable to happen at the time of connection of the mutual resupply ports.

In this way, the paired toner resupply ports of the developing device and the resupply hopper are connected to permit resupply of toner from the resupply hopper. Meanwhile, when the support member 3 is withdrawn from the apparatus body, the toner resupply section 70 can be automatically disconnected from the toner resupply section 90 without the possibility of causing toner leakage.

More specifically, when the support member 3 is withdrawn from the apparatus body 3, the pin 77 is retreated to first release the pressing action imposed on the shutter plate 94. With a slight time lag, the shutter plate 74 becomes free from the pressing action against the front edge 90A of the toner supply section 90, so that the resupply port 71 is gradually closed while keeping its opening larger than that of the resupply port 91 at all times in a like manner to the loading process. As soon as the toner resupply section 70 is detached from the toner resupply section 90, both the sections are automatically returned to the shielded state as shown in FIG. 3. Note that although the opening and closing lids are used on both sides in the above description, the opening and closing lid may be provided on either one side alone depending on the arrangement and the opening and closing fashion of both the toner resupply sections.

Replenishment of toner to the toner hopper 87 from the exterior is effected by attaching a developer cartridge containing toner of a specific color, i.e., blue in this case, to a mount base 87A on the top of the resupply hopper 87. The mount base 87A is configured such that any developer cartridge containing toner other than blue one cannot be attached thereto. Thus, there is no possibility of erroneously replenishing red or black toner to the developing device 37. This technique is also applied to the resupply hoppers 86 and 88 as well. According to the purpose of the present invention, the developer cartridges of specific colors may be attached to the respective resupply hoppers through another fool-proof mechanism, so that the developer cartridges of specific colors are attached to only the particular corresponding resupply hopper positions, respectively.

Figure 7:
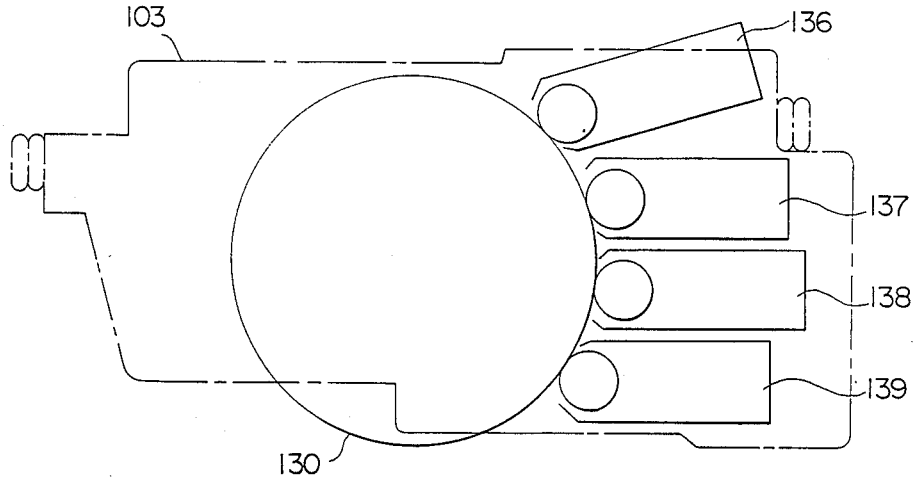
FIG. 7 is a conceptual view showing another layout of the developing devices.

In a multicolor image forming apparatus using a larger number of developing devices, as shown in FIG. 7, one developing device 136 and/or still another developing device 139 may be mounted obliquely with its part projecting from the profile of the support member 103 to the extent in which no trouble occurs in inserting and removing a support member 103 with respect to the apparatus body, depending on demand in relation to the rail arrangement or the like intended for compactness and improvement in operability, so long as the support member 103 can carry thereon at least two developing devices 137, 138 horizontally in a stacked assembly.

Incidentally, although the foregoing embodiment has been described in connection with the multicolor image forming apparatus relying on non-contact, superposed multi-rotation process, the present invention is not limited to the superposed, multi-rotation image forming technique. It has proved that the foregoing compact developing devices can provide a good image even in case of the contact developing system, embodiments are not limited to any particular forms based on the purpose of the present invention.

For example, irrespective of any developing systems such as the monocolor system and the multi-color system having such a structure that a plurality of developing devices are held away from the image retainer during non-operation and brought into contact with the image retainer during operation, or the above-mentioned contact and non-contact developing systems, or the widely used jump developing system utilizing the AC bias, any forms of various color image forming apparatus equipped with a plurality of developing devices are included in the purpose of the present invention, so long as the developing devices are automatically connected to and disconnected from the respective resupply hoppers upon insertion and removal of the support member, or the developing devices are installed into the support member through fool-proof mechanisms and hence connected to the respective resupply hoppers in a fool-proof manner, which is intended by the present invention.

Figure 8:
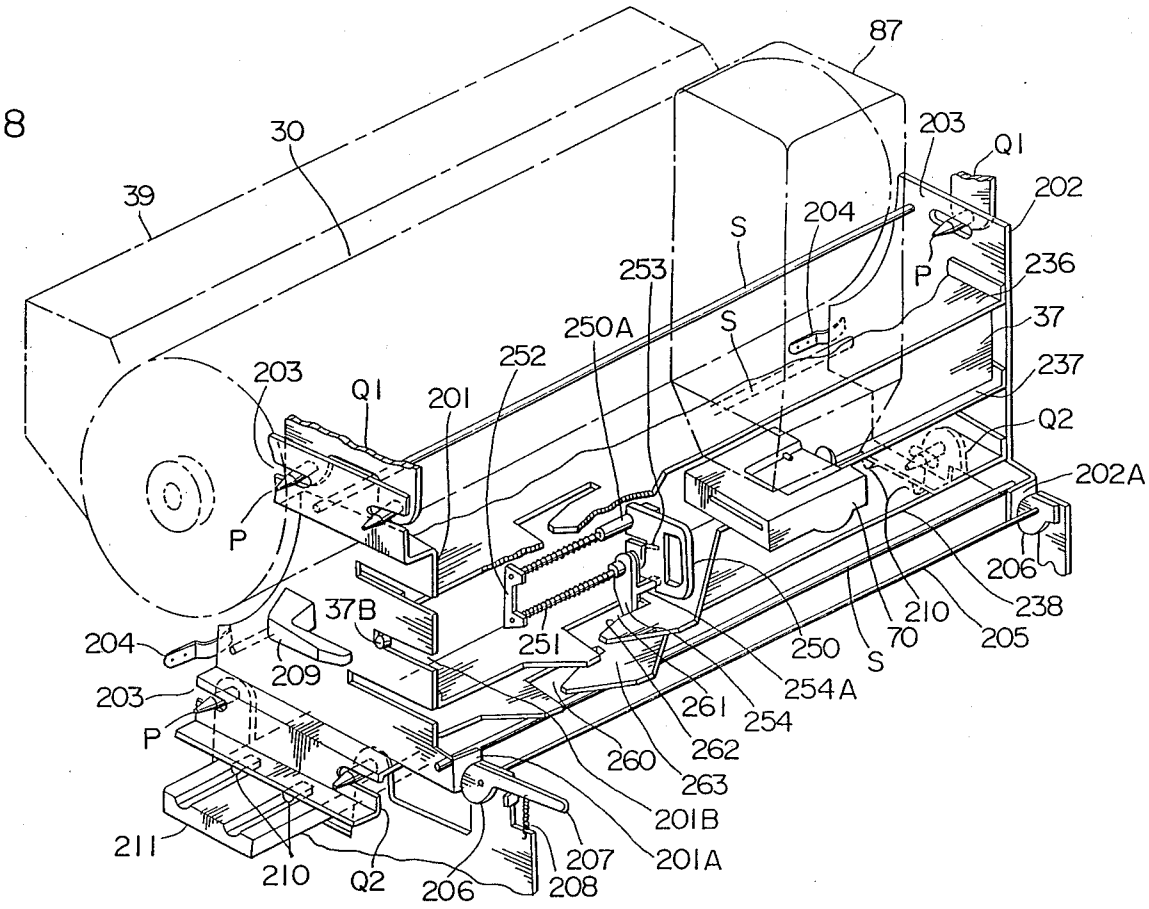
FIG. 8 is a perspective view showing another embodiment using a developing garage.

Therefore, the foregoing objects and effects are also applied to an embodiment as shown in FIG. 8. In FIG. 8, the image retainer 30 and the cleaning device 39 are directly attached to a pair of front and rear base plates fixed to the apparatus body 2. The developing devices 36, 37, 38 are installed into a developing garage 200 which is then detachably mounted in the apparatus body 2.

The developing garage 200 has a pair of plates 201 and 202 interconnected by three stays S into an integrated structure. Between the plates 201 and 202, there are disposed trays 236, 237, 238 on which the developing devices 36, 37, 38 are to be placed, respectively. The developing garage 200 is inserted in place inside the apparatus body 2 by engaging a total of six elongate holes 203 bored in the plates 201 and 202 in their upper and lower portions with corresponding reference pins P projecting from suspending members Q1 and erecting members Q2 extending from the base plates, respectively.

While being inserted in the apparatus body 2, the developing garage 200 is restricted in its depthwise direction by a click device (not shown) and also urged by the action of a pair of elastic members 204 in the direction away from the image retainer 30. At the same time, bent portions 201A, 202A of the plates 201, 202 are pushed back upon rotation of a pair of cams 206 which are interconnected by a connecting rod 205 in the same angular phase, so that the developing garage 200 is pressed and moved toward the image retainer 30 against the action of the elastic members 204.

As a result, the developing devices can be installed to accurately set gaps between the image retainer 30 and the developing sleeves 361, 371, 381 with the aid of means for restricting the developing gaps.

Further, the developing garage 200 can easily be withdrawn and removed from the apparatus body 2 by simple operation.

More specifically, when a lever 207 having the cam 206 formed at its distal end as a unitary structure is turned counterclockwise against the action of a tension spring 208, the pressing forces imposed upon the bent portions 201A, 202A are released and the developing garage 200 is moved away from the image retainer 30 by reaction forces of the elastic members 204.

In this state, when a grip 209 on the front face is pulled to slightly withdraw the developing garage 200, the elongate holes 203 of the plates 201, 202 are supported on the tapered portions at the tips of the reference pins P, respectively, and hence the developing garage 200 is somewhat lowered as a whole, so that slide members 210 attached to the lower ends of the plates are brought engagement with grooves defined in a guide rail 211 which is supported by the base plates.

The guide rail 211 has a length equivalent to the depthwise size of the developing garage 200, and hence the developing garage 200 can entirely be removed and separated from the apparatus body 2 by further withdrawing the grip 209.

When inserting and loading the developing garage 200 into the apparatus body 2, the slide members 210 on the side of the plate 202 are first fitted, engaged and pushed in the grooves of the guide rail 211, and the opposite slide members 210 on the side of the plate 201 are then fitted, engaged and pushed in the grooves thereof, whereby the elongate holes 203 of the plates 201 and 202 are guided to the tapered portions at the tips of the corresponding reference pins P, allowing the developing garage 200 to be floated from the guide rail 211 and set to an installed state as shown in FIG. 8.

Incidentally, the plate 202 is sized such that it can pass through between the suspending member Q1 and the erecting member Q2 located on the side of the plate 201. Also, in order to retract the cams 206 from the bent portions 201A, 202A of the panels when the developing device is installed into the apparatus body 2, there is provided a latching device (not shown) to temporarily lock the lever 207 at a counterclockwisely rotated position.

The developing devices 36, 37, 38 are assembled into the developing garage 200 with the following installation mechanism so that they may readily be loaded and unloaded.

The case of the developing device 37 will now be described. On the back surface of the developing device 37, a pair of vertically spaced guide pins 251 each having a compressed spring fitted therearound is mounted between a pair of laterally spaced holders 252, so that a grip 250 slidably fitted over the guide pins 251 is urged rightward.

The grip 250 is fitted over and supported by the guide pins 251 through a pair of upper and lower bosses 250A. A pressing lever 254 urged counterclockwise by means of a torsion spring 253 is fixedly fitted over the lower boss 250A.

On the other hand, the developing garage 200 includes the tray 237 fixed thereto, and the tray 237 has a key-like cutout 260 on its side edge at a position corresponding to the pressing lever 254.

In the state where the developing device 37 is installed in the developing garage 200, the pressing lever 254 is held in abutment against a linear portion 261 of the cutout 260 and hence slightly pushed clockwise. The resulting reaction force causes the developing device 37 to be pressed toward the image retainer 30 to keep the gap (Dsd) between the image retaining surface and the developing sleeve at a prescribed value (for example, the gap is ensured by such a structure that a roller provided concentrically on the developing sleeve is abutted against the photosensitive drum, though not shown).

When removing the developing device 37 from the developing garage 200, the grip 250 is slid leftward against the resilient action of the compressed springs, so that the pressing lever 254 now contacts a tapered portion 262 and starts to return back counterclockwise. During this return stroke, a projection 254A strikes against the grip 250, whereupon the pressing lever 254 is stopped.

Therefore, by withdrawing the grip 250 at a position where the boss 250A is striking against the holder 252, the pressing lever 254 comes off from an opening of the cutout 260, thereby allowing the developing device 37 to be removed and separated from the developing garage 200.

On the contrary, when installing the developing device 37 into the developing garage 200, the front end portion of the developing device 37 is placed on the tray 237, and a pin 37B attached to the side of the developing device 37 is pushed to be engaged in a groove 201B defined in the plate 201, whereupon the pressing lever 254 on the grip 250 positioned at the right ends of the guide pins 251 under the action of the compressed springs now abuts against a tapered portion 263 on the front side. Then, the pressing lever 254 is slid leftward together with the grip 250 on the guide pins 251 following an inclination angle of the tapered portion 263.

When the developing device 37 is further pushed at a position where the pressing lever 254 is facing the opening of the cutout 260, the grip 250 now slides rightward under the action of the compressed springs, and the pressing lever 254 comes into slide contact with the tapered portion 262. Then, the pressing lever 254 enters a range of the linear portion 261 while being rotated slightly clockwise, so that the developing device 37 is brought into the urged state as mentioned above. Note that the developing devices 36, 38 can also be loaded into the developing garage 200 in a detachable manner using a similar installation mechanism.

Further, each of the developing devices 36, 37, 38 is installed into the developing garage 200 through a foolproof mechanism in the form of a fitting mechanism which is made up by selection of various dimensions such as length, depth, width and relative positional relationships, as well as single or multiple combinations of the mechanical elements comprising pairs of recesses such as grooves, holes, cutouts, etc. and projections such as dowels, rails, etc.

For example, the height at which the pin 37B is to be engaged in the groove 201B is made different depending on types of the developing devices to prevent erroneous installation of another type of developing device.

Throughout the foregoing and just above embodiments, the resupply hoppers 86, 87, 88 prepared for replenishing toner to the developing devices 36, 37, 38, respectively, are directly attached to and supported by a hopper mount plate 85 fixed to the apparatus body 2 separately from the developing garage 200. Attendant on the operation to install or remove the developing garage 200 with respect to the apparatus body 2, resupply ports of the resupply hoppers 86, 87, 88 can automatically be connected to or disconnected from those of the developing devices 36, 37, 38, respectively.

Figure 9:
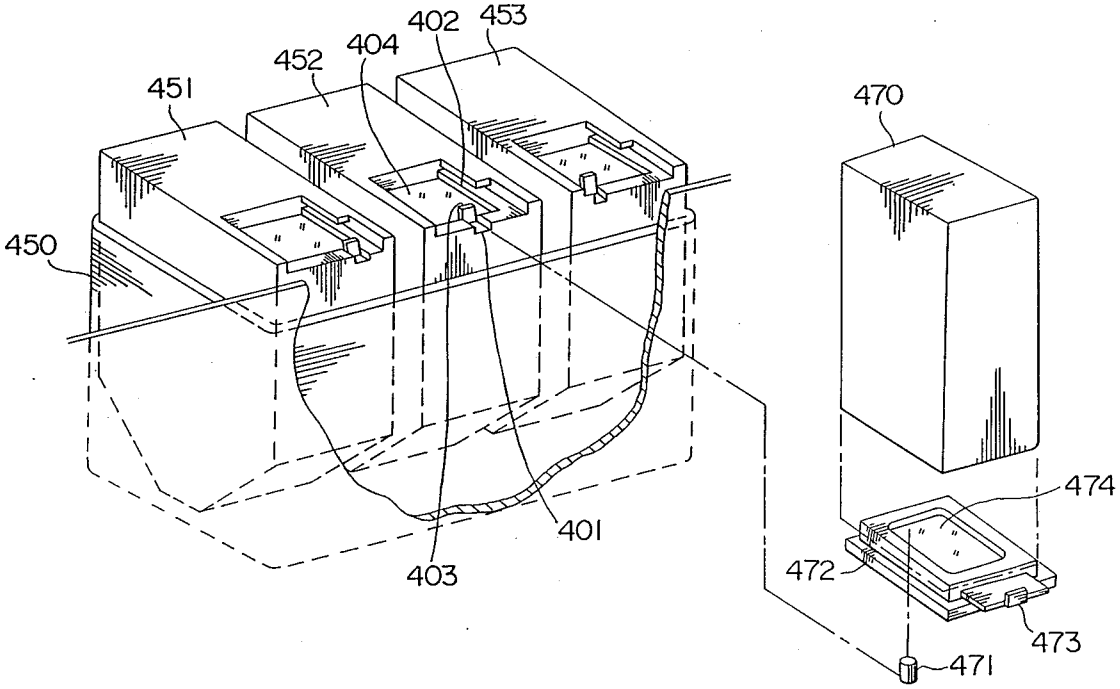
FIGS. 9, 10, 11 and 12 are perspective views showing respective of the resupply hoppers and of the respective developer cartridges.
Figure 11:
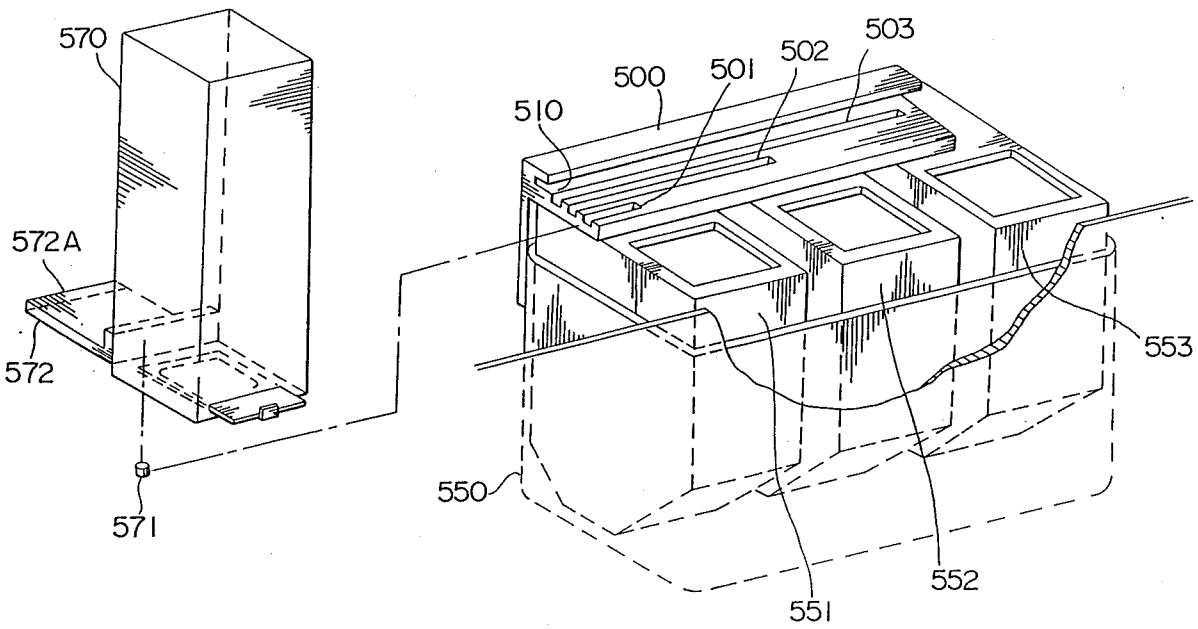

FIGS. 9 and 11 show three resupply hoppers 451, 452, 543 or 551, 552, 553 containing developers of red, blue and black colors, respectively, which are attached to and arranged in a container 450 or 550 in an overlapping relation as viewed from front of the apparatus. The associated fool-proof mechanisms are constructed as follows.

More specifically, in FIG. 9, a developer cartridge of specific color can be attached to the corresponding resupply hopper when a bottom plate 472 of a developer cartridge 470 is inserted and engaged in a guide portion 402 at the top of the resupply hopper 452 having a cutout 401 at a position corresponding to a pin 471 on the lower surface of the bottom plate 472. With further insertion, the front edge of the plate 472 pushes a rising portion 403 against its elastic action to automatically open a shield plate 404. Thus, by pulling a pawl 473 on the developer cartridge 470 to open a shield plate 474, the developer is now dropped and replenished.

Figure 10:
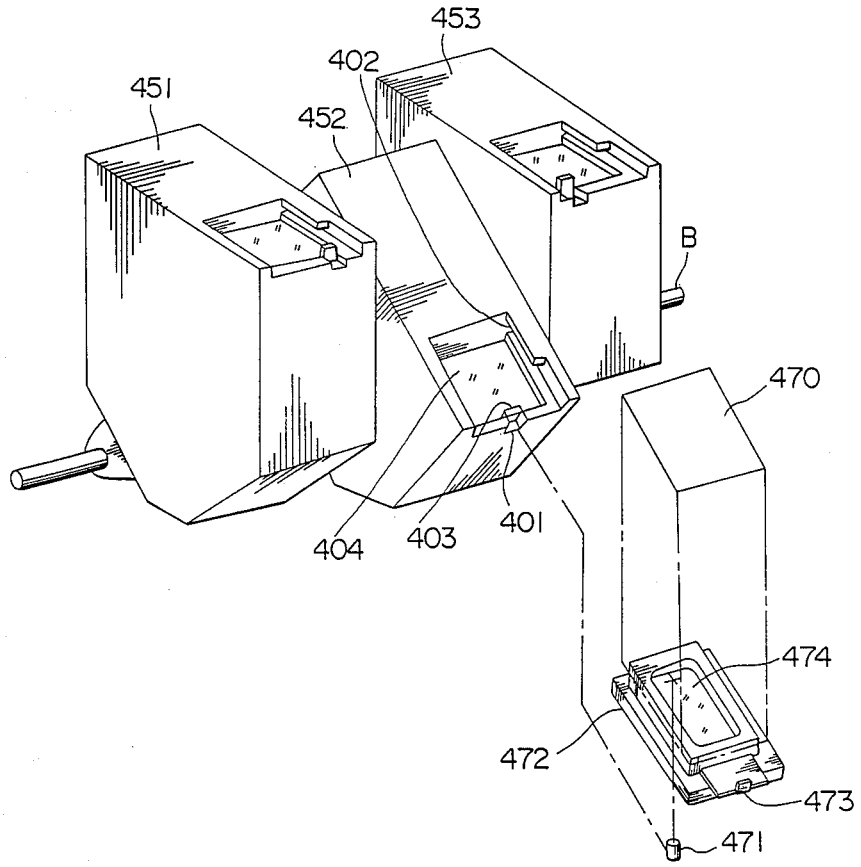

This system can also be applied to a color image forming apparatus of the type, as shown in FIG. 10, where any of resupply hoppers can be turned for structural reason or for convenience of the handling operation. As illustrated in examples of FIGS. 9 and 10, it is possible to commonly use main housings of the respective resupply hoppers (boxes in the illustrated embodiment), and employ individual components only at the upper engaging portions. This contributes to increase the manufacturing efficiency and lower the cost. The above is true for the developer cartridges as well. Common use of the main housings of the respective resupply hoppers is also applied to an embodiment of FIG. 12.

Meanwhile, in FIG. 11, a developer cartridge 570 has plate 572 which is provided with a pin 571 spaced from an end face 572A through a particular distance. Depending on a selective stop position of the pin 571, the developer cartridge 570 can be attached to a particular resupply hopper 552.

As with the foregoing embodiments, each of the developer cartridges can be attached to the corresponding resupply hopper through a fool-proof mechanism in the form of a fitting mechanism which is made up by selection of various dimensions such as length, depth, width and relative positional relationships, as well as single or multiple combinations of the mechanical elements comprising pairs of recesses such as grooves, holes, cutouts, etc. and projections such as dowels, rails, etc.

In the example of FIG. 11, a mount container 550 for accommodating therein the resupply hoppers 551, 552, 553 is integrally provided with a guide portion 510 into which the plate 572 is to be fitted, and a common guide plate 500 having formed therein three grooves 501, 502, 503 of different lengths from each other.

Figure 12:
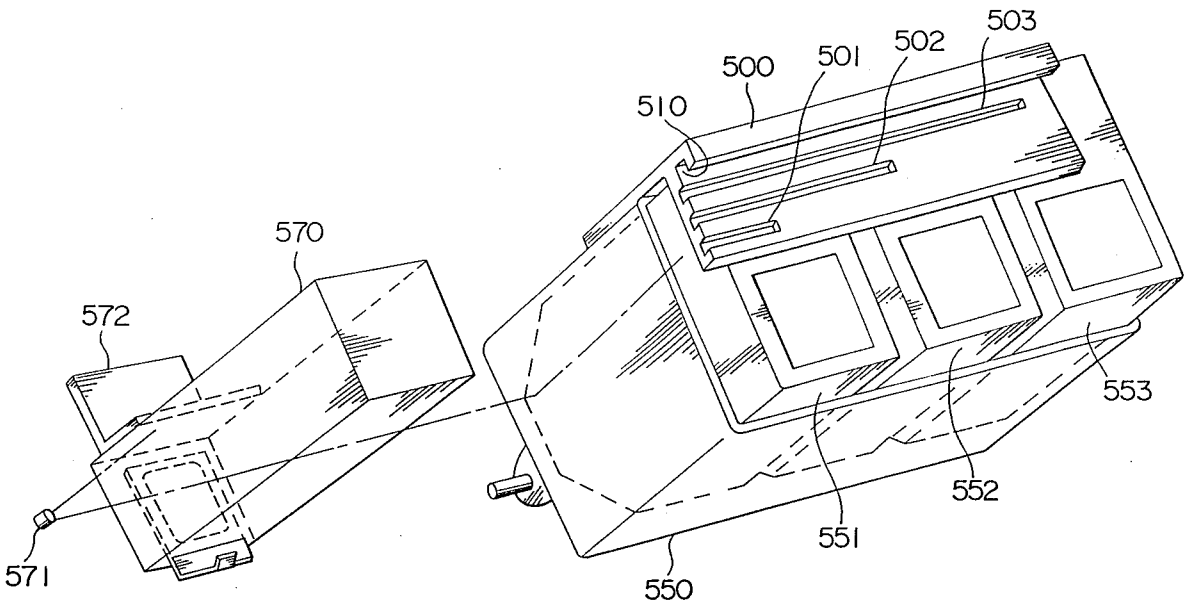

Thus, the system of FIG. 11 is applied to an image forming apparatus of the type where all of the resupply hoppers are simultaneously turned together, as shown in FIG. 12. Therefore, that system can be utilized in the resupply hoppers of integral type or separate type for effecting appropriate combinations of resupply hoppers rotatable individually or simultaneously.

Although the first mentioned embodiment has been described as mounting an image retainer and a cleaning device together with developing devices on a common support member and then assembling the support member into the apparatus body, the present invention can satisfactorily practiced in developing devices of so-called garage system in which the developing device group only is separately installed into the apparatus body in a detachable manner.

Effect of the Invention

In summary, the present invention can achieve the following points. Principal components including the image retainer, the respective developing means and the cleaning means are mounted on the support member independently of the apparatus body in the form of a unit, so that the principal components can be installed and removed with respect to the apparatus body with very simple operation. The respective developing means can automatically be connected to and disconnected from the corresponding resupply hoppers upon installation and removal of the support member. Further, the developing means and the resupply hoppers for feeding toner thereto are supported or fixed to only their own particular positions on the support member or the apparatus body, thereby making it possible to surely replenish toner of a specific color to the corresponding developing device with no possibility of error. The complicated operations necessary for the above connection and disconnection, which had to been carried out in the past, and the attendant toner leakage can be eliminated. Particularly, a considerable trouble of replenishing toner of a different color other than a specific one, which may cause a fatal trouble in the image forming apparatus using color toner, can be avoided. Consequently, there can be provided a useful image forming apparatus which has excellent operability and high reliability.

Other advantageous effects are as follows:

(1) Since the respective developing devices are arranged horizontally in a stacked assembly and hence require no intricate individual arrangement thereof, and at least two or more developing devices are used commonly, both necessary operation and maintenance are significantly simplified even in handling a plurality of developing devices. The developing devices horizontally arranged in a stacked assembly can be withdrawn individually in parallel relation at the time of maintenance, so that mechanism and operation are further simplified. Thus, with the developing devices mounted on the support member in an integral structure, it becomes possible to first withdraw the support member forward and then withdraw a plurality of developing devices horizontally (in the direction of the front of the photosensitive drum) in parallel relation, so that the withdrawing operation becomes simple and both the drum and the developing unit can be withdrawn with a single operation. Furthermore, the complexity of the mechanical structure is lessened, and maintainability and operability are facilitated. Of course, as a result of rationalization of a plurality of structures (developing devices) such as common use and compact size, respective parts can be simplified and commonly used because of similarity, which leads to a reduction in cost, a reduction in the number of parts, and hence an improvement in reliability.

(2) With above construction, the gaps between the every adjacent developing devices can be made almost uniform and small in the direction of rotation of the photosensitive drum. Also, since the distance from the charging and exposure locations to the respective developing devices is shortened, it becomes possible to restrain an influence to be given by a difference in the attenuated amounts of potential among the developing devices located at different positions. Since the support member including the developing devices as an integral structure is suspended in the apparatus body, an influence by vibration and shock can be reduced. Particularly, in the case of non-contact development for superposed, multi-rotation image forming, it is possible to prevent color mixing and deterioration of color balance caused by fluctuations of Dsd and the applied biases, thereby improving the image quality on the whole.

(3) With a view of solving the above-mentioned problems, according to the present invention, a group of a plurality of developing devices are each constituted by a compact and thin developing device, separately from the associated resupply hopper, which does not affect image properties and can provide good image quality. At least main parts of the housing of the developing device can commonly be utilized for two or more devices. More practically, the compact and thin developing devices are arranged horizontally in a stacked assembly in parallel with an image retainer axis, and preferably they are all located within the drum diameter of the image retainer. A plurality of developing devices containing respective developers of specific colors can be set in their own particular positions opposite to the image retainer. The developing devices are integrally mounted on the support member which can be inserted into and withdrawn from the apparatus body, and when the support member is inserted and withdrawn, opening and closing shutter means provided at the respective resupply ports of a plurality of resupply means fixedly provided in the apparatus body can automatically be opened and closed and also connected to and disconnected from the corresponding resupply ports of a plurality of developing devices associated with the resupply means containing toner of respective colors. Thus, operation is fully automated and simplified, and hence reliability is improved.

In addition, a safety mechanism is disposed by which each developing device containing toner of a specific color can be attached and loaded at a specified position for that specific color with certainty. There can thus be provided a multicolor image forming apparatus in which a plurality of developing devices can be installed at and removed from their predetermined load positions correctly and without error through simply handling.

What is claimed is:

1. A multicolor image forming apparatus comprising an apparatus body, a plurality of developing devices for forming a multicolor image, a plurality of resupply devices for replenishing toner particles to each of said developing devices, and a support member for integrally supporting said plurality of developing devices, wherein said support member integrally supporting said plurality of developing devices is mounted detachably on said apparatus body, and each of said developing devices and each of said resupply devices corresponding to each of said developing devices are automatically connected to and disconnected from each other, when said support member is inserted into and withdrawn from the apparatus body.

2. The multicolor image forming apparatus according to claim 1, characterized in that said support member further supports an image retainer integrally.

3. The multicolor image forming apparatus according to claim 2, characterized in that said support member further supports a cleaning device integrally.

4. The multicolor image forming apparatus according to claim 1, wherein said support member is a garage.

5. The multicolor image forming apparatus according to claim 1, wherein each of said developing devices is in engagement with only a specific one of said plurality of resupply devices.

6. The multicolor image forming apparatus according to claim 1, wherein each of said developing devices is mounted detachably on said support member.

7. The multicolor image forming apparatus according to claim 6, wherein each of said developing devices is mounted only at a predetermined position on said support member.

8. A multicolor image forming apparatus comprising an apparatus body including an image retainer and process means such as a charging means for imparting electric charges to the image retainer, exposure means for performing image-exposing on the charged image retainer according to multicolor image information, a plurality of developing means for developing electrostatic latent images formed on the image retainer by the exposure means, transfer means for transferring the developed image onto a recording medium, cleaning means for cleaning toner particles remaining on the image retainer after transfer, and a plurality of resupply means for replenishing toner to the plurality of developing means, wherein at least said image retainer and said plurality of developing means are integrally supported on a support member which can be inserted into and withdrawn from the apparatus body, and mutual developer resupply portion of the plurality of developing means and the plurality of resupply means provided in the apparatus body separately from the support member are automatically connected to and disconnected from each other, when the support member is inserted into and withdrawn from the apparatus body.

9. The multicolor image forming apparatus according to claim 8, characterized in that each of said plurality of developing means corresponding to each specific color can be mounted at a specific position with respect to the image retainer.

10. A multicolor image forming apparatus according to claim 8, wherein each of the plurality of resupply means is detachably mounted only to a developer cartridge corresponding to a specific color.

11. A multicolor image forming apparatus comprising an apparatus body including an image retainer and process means such as a charging means for imparting electric charges to the image retainer, exposure means for performing image-exposing on the charged image retainer according to multicolor image informations, a plurality of developing means for developing electrostatic latent images formed on the image retainer by the exposure means, transfer means for transferring the developed image onto a recording medium, cleaning means for cleaning toner particles remaining on the image retainer after transfer, and a plurality of resupply means for replenishing toner particles to the plurality of developing means, wherein the plurality of developing means are integrally mounted on a garage member which can be inserted into and withdrawn from the apparatus body, and the plurality of developing means and the plurality of resupply means provided in the apparatus body separately from the garage member are connected to and disconnected from each other corresponding to a specific color through a fool-proof mechanism, when the garage member is inserted into and withdrawn from the apparatus body.

12. A multicolor image forming apparatus comprising an apparatus body including an image retainer and process means such as a charging means for imparting electric charges to the image retainer, exposure means for performing image-exposing on the charged image retainer according to multicolor image information, a plurality of developing means for developing electrostatic latent images formed on the image retainer by the exposure means, transfer means for transferring the developed image onto a recording medium, and cleaning means for cleaning toner particles remaining on the image retainer after transfer, wherein each of the plurality of developing means corresponding to each specific color can be mounted at a specific position with respect to the image retainer.

13. The multicolor image forming apparatus according to claim 12, characterized in that said image retainer and said plurality of developing means are integrally mounted on a support member which can be inserted into and withdrawn from the apparatus body.

* * * * *